United States Patent [19]

Ermolenko et al.

[11] Patent Number: 4,546,063

[45] Date of Patent: Oct. 8, 1985

[54] PHOTOGRAPHIC MATERIAL

[76] Inventors: Igor N. Ermolenko, ulitsa Akademicheskaya, 7, kv. 23; Vasily D. Koshevar, ulitsa Shirokaya, 36, kv. 404, both of Minsk; Viktor S. Nedzvetsky, ulitsa Planernaya, 1, korpus 2, kv. 55, Moscow; Galina N. Savastenko, ulitsa Vostochnaya, 17, kv. 114, Minsk; Valentina M. Siderko, prospekt Pushkina, 47, kv. 142, Minsk; Fedor N. Kaputsky, ulitsa Chervyakova, 4, kv. 63, Minsk; Valentina V. Komar, ulitsa Akademicheskaya, 17, kv. 3, Minsk; Juzefa I. Nadievskaya, ulitsa Shirokaya, 36, kv. 813, Minsk, all of U.S.S.R.

[21] Appl. No.: 698,733

[22] Filed: Feb. 4, 1985

Related U.S. Application Data

[60] Division of Ser. No. 499,419, Jun. 2, 1983, abandoned, which is a continuation of Ser. No. 227,058, filed as PCT SU79/00006, Feb. 22, 1979, published as WO80/01848, Sept. 4, 1980, § 102(e) date Oct. 16, 1980, abandoned.

[51] Int. Cl.[4] ..... G03C 1/90

[52] U.S. Cl. ..... 430/269; 430/270; 430/413; 430/417; 430/531; 430/614

[58] Field of Search ..... 430/269, 413, 417, 270, 430/641, 531

[56] References Cited

U.S. PATENT DOCUMENTS

| | | | |
|---|---|---|---|
| 2,127,621 | 8/1939 | Staud et al. | 430/641 |
| 2,725,293 | 11/1965 | Talbot et al. | 430/641 |
| 3,338,716 | 8/1967 | Gardner et al. | 430/641 |
| 3,852,070 | 12/1974 | Levinos | 430/417 |
| 3,873,317 | 3/1975 | Kato et al. | 430/269 |
| 4,049,457 | 9/1977 | Rice et al. | 430/270 |
| 4,078,140 | 3/1978 | Roman et al. | 430/56 |
| 4,312,934 | 1/1982 | Rice et al. | 430/270 |

FOREIGN PATENT DOCUMENTS 1338435 11/1973 United Kingdom .

*Primary Examiner*—Jack P. Brammer
*Attorney, Agent, or Firm*—Burgess, Ryan & Wayne

[57] ABSTRACT

A photographic material comprises acid esters of cellulose or copolymers of acid esters of cellulose and synthetic comonomers.

The invention may be used in the photographic industry for producing line and half-tone images on paper, films and cloth. Moreover, the proposed photographic material may be used for direct recording of ultraviolet radiation.

12 Claims, No Drawings

PHOTOGRAPHIC MATERIAL

This application is a division of application Ser. No. 499,419, filed June 2, 1983, now abandoned, which is a continuation of application Ser. No. 227,058, filed Oct. 16, 1980, now abandoned.

The invention relates to the photographic industry, and more specifically to non-silver photographic materials enabling the production of a developed image consisting of metal particles.

FIELD OF THE ART

The invention may be used in the photographic industry for producing line and half-tone images on paper, films and cloth. The photographic material according to the invention may be used, e.g. in reproducing drawings for mechanical engineering, and making publicity posters. The photographic material according to the invention may be used in instruments featuring photorecording, having ultraviolet radiation sources, or for a direct recording of ultraviolet radiation.

BACKGROUND ART

Known in the art are a large number of silver-halide photographic materials comprising a light-sensitive layer applied to a support. Multicomponent composition of the light-sensitive layer in the known materials causes non-uniformity of distribution of structural light-sensitive elements over the support surface thus resulting in coarse graininess of image. In wet condition and at high temperature, the light-sensitive layer is easily separated from the support. Moreover, known silver-halide photographic materials cannot be used for recording far ultraviolet radiation owing to a strong inactive absorption of radiation in the gelatin of the light-sensitive layer.

Known in the art are also photographic materials on which an image is obtained owing to processes of photopolymerization or chemical conversions of polymers. These materials are, however, difficult to manufacture, they require the use of difficulty available and costly reactants, and an image which in a number of applications consists of organic dyes, is poorly conserved. The known materials are mainly heterogeneous systems, and their resolution is limited by non-uniformity of the system as a whole (cf. U.S. Pat. No. 3,368,900, U.S. Pat. No. 3,259,499, German Pat. No. 2,118,609).

Known in the art is a homogeneous photographic material based on monocarboxyl cellulose, comprising a copolymer of anhydro glucose and anhydrouronic acid. Upon an incidence of ultraviolet radiation on this photographic material, centers of latent image are formed, which may be visualized under the action of a physical developer (cf. USSR Inventor's Certificate No. 244888).

Resolution of this photographic material is higher than that of known heterogeneous photographic materials; however, this homogeneous material on the basis of cellulose is deficient in a low light sensitivity, instability upon long storage, low physical and mechanical properties during chemical and thermal treatment (treatment in alkaline solutions, heating). Apart from the above-said, the preparation of such photographic material is associated with the use of toxic substances—nitrogen oxides.

DISCLOSURE OF THE INVENTION

It is an object of the invention to provide a homogeneous photographic material based on cellulose, modified with such compounds as to exhibit an improved light sensitivity and stability upon long-term storage.

This object is accomplished by that a photographic material consisting of a modified light-sensitive cellulose, according to the invention, consists of acid ethers and esters of cellulose or copolymers of acid esters of cellulose and synthetic comonomers.

The use of acid esters of cellulose or copolymers of acid esters of cellulose and synthetic comonomers enables the preparation of a photographic material exhibiting an improved light sensitivity, stability during storage, and resistance to thermal and chemical factors. Uniform structure of the photographic material according to the invention ensures the absence of manifest graniness of image and rather high resolution which is mainly limited by the grain of the material only. By preparing the material according to the invention with the employment of up-to-date high-performance equipment used for the manufacture of known polymeric materials (paper, films), the complicated and expensive process of preparing photoemulsion layers and their application to a support may be dispensed with. The photographic material according to the invention enables the production of an image without using silver. Moreover, a doubtless advantage of the material according to the invention resides in its suitability for use and treatment (for visualizing the image) in the daylight, because the photographic material according to the invention is only sensitive in the ultraviolet spectral area.

According to the invention, as an acid ester of cellulose, use is preferably made of carboxymethyl cellulose. The use of carboxymethyl cellulose enables the provision of a light-sensitive material exhibiting a comparatively high sensitivity in respect in the ultraviolet spectral area with no sensitivity in the visible spectral area, thereby determining a promising field of application of new photographic materials according to the invention for recording ultraviolet rays in the presence of diffused visible light, because the recording materials used so far for the ultraviolet spectral area in many instances exhibited higher sensitivity to the visible area than to the short-wave area.

According to the invention, acid esters of cellulose, apart from carboxyls, preferably contain also acetyls. This embodiment of the invention enables the preparation of photographic films by way of chemical modification of cellulose materials which are commercially available with any desired thickness, the films being stable during storage. A photographic material on the basis of an acid ester of cellulose containing, in addition to carboxyls, also acetyls may be used as a negative material. It should be noted that negatives obtained on the new photographic materials according to the invention may be used (without additional steps) for reproduction on silver-halide and other known photographic materials with the employment of conventional equipment. And, vice versa, reproductions from negatives on silver-halide and other known materials may be obtained using the photographic material according to the invention by the same methods as those used at present, with the only difference residing in that the negative support and the emulsive medium should be transparent in the ultraviolet spectral area, and a light source should provide ultraviolet radiation.

To improve fire and heat resistance of the photographic materials so that they might be used in large-size publicity posters, according to the invention, an acid ester of cellulose preferably comprises cellulose phosphate.

To enlarge the range of spectral sensitivity of the materials and improve general light sensitivity, according to the invention, salts of acid ethers and esters of cellulose are preferably used. The use of silver, platinum, palladium, iron, bismuth and lead salts enables the employment of a single-bath development process reduction—thus considerably simplifying the process of obtaining an image on the photographic material according to the invention.

In case salts of acid esters of cellulose according to the invention comprise iron, bismuth or lead salts, a copperformaldehyde developer may be used for the development, that is the use of valuable metals is dispensed with at all stages of the photographic process, whereby low production cost of photographic materials is ensured.

An embodiment of the invention resides in that the above-described photographic material is applied to a support. This offers the possibility of using acid esters of cellulose commercially available in the form of powder for their application to a solid support.

Further objects and advantages of the invention will become apparent from the following detailed description of the photographic material and examples thereof.

BEST MODE OF CARRYING OUT THE INVENTION

According to the invention, there is contemplated a photographic material made of acid ethers and esters of cellulose or copolymers of acid esters of cellulose and synthetic comonomers. The studies revealed that acid esters of cellulose exhibit a sensitivity in respect to UV radiation and form metastable electron-excess centers of latent image. As shown by experimental studies, as photographic material use may be made of cellulose esters containing acid groups and varying in their structure: carboxyl-containing esters-carboxymethyl cellulose, cellulose esters with malonic, citric, tartaric, glutaric, etylenediamine tetracetic, succinic, maleic phthalic and adipic acids, as well as acid esters of cellulose with polybasic inorganic acids, such as phosphoric and sulphuric acids.

Acid esters of cellulose according to the invention are prepared, as is known, by reacting a cellulose material with esterifying acid-containing reactants. By varying concentration of reactants, thermal and time performance of treatment, acid esters of cellulose may be prepared with various content of acid groups. The content of acid groups in the photographic material according to the invention ranges from 0.3 to 17% by weight.

Thus, it is known that carboxymethyl cellulose is prepared by reacting an alkali cellulose with monochloroacetic acid:

$$[C_6H_7O_2(CH)_3]_n + nClCH_2COOH + 2nNaOH \rightarrow [C_6H_7O_2(OH)_2OCH_2COONa]_n + nNaCl + 2nH_2O$$

Sulphoethyl cellulose is prepared by reacting cellulose with chloro- or bromo-ethylsulphonate in an alkali medium:

$$ROH \xrightarrow{NaOH} R{-}ONa \xrightarrow{ClCH_2CH_2SO_3Na} ROCH_2CH_2Si_3Na,$$

wherein R is cellulose radical.

Cellulose citrates are prepared by impregnating a cellulose material with a 20% solution of citric acid, drying and heat treatment.

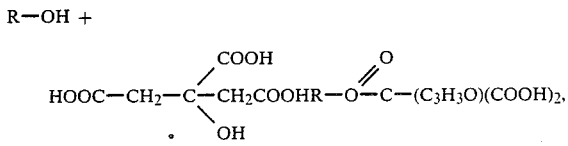

wherein R is cellulose radical.

Cellulose phosphates are prepared by treating cellulose with aqueous solutions of ortho-phosphoric acid and urea under heating:

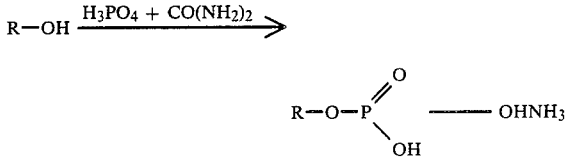

wherein R is cellulose radical.

The use of carboxymethyl cellulose enables the preparation of a photographic material exhibiting comparatively high sensitivity in the ultraviolet spectral area with the absence of sensitivity in the visible spectral area, which makes the new photographic materials according to the invention promising for recording ultraviolet radiation in the presence of diffused visible light.

According to the invention, it has been found that acid ethers of cellulose containing, in addition to carboxyls, also acetyls exhibit a sensitivity in the ultraviolet spectral area. This enables the preparation of photographic films by way of a chemical modification of commercially available cellulose materials. A photographic material on the basis of an acid ether of cellulose containing, in addition to carboxyls, also acetyls may be used as a negative material suitable for reproduction on silver-halide and other conventional photographic materials.

It has been found that by using as acid esters of cellulose cellulose phosphate fire and heat resistance of photographic materials may be improved.

The use as light-sensitive material of copolymers of acid esters of cellulose and synthetic comonomers improves physical and mechanical characteristics of the material, such as tensile strength and resistance to attacking media. Thus, the use of a copolymer of cellulose phosphate and polyacrylonitrile enables the preparation of a photographic material exhibiting an improved resistance to an alkali medium.

The choice of synthetic comonomers will depend on optical properties, first of all on absorption in the UV range of the spectrum, various aspects of photochemical treatment should be borne in mind, such as the efficiency of diffusion of aqueous solutions into the bulk of a polymer. Therefore, depending on requirements imposed on a given light-sensitive material, as comonomers, use may be made of products exhibiting various hydrophilic and soaking capacity, and differing optical properties.

It will be apparent from the above that the preparation of acid esters of cellulose is simple in manufacture so that complicated and expensive processes of making a light-sensitive emulsion and its applications to a support required in the preparation of conventional photographic materials are dispensed with.

A great advantage of the photographic material according to the invention resides in the possibility of its preparation, use and treatment in daylight.

As the ability of forming a latent image is inherent in acid esters of cellulose proper, rather than in additives thereto, the new photographic materials may be prepared in any physical form similar to cellulose products: in the form of films, paper, fabrics, yarn, emulsion. The photographic materials according to the invention may be light-sensitive either over the entire volume (in case of materials without support) or to any pre-set depth.

During the studies of photochemical transformations of acid esters of cellulose under the action of ultraviolet radiation, an effect of the formation of a latent image which can be physically developed was revealed.

It should be noted that, speaking of the whole class of acid esters of cellulose, a common feature residing in the ability of forming metastable electron-excess centers of latent image under the action of ultraviolet radiation, which are chemically developed with an intensification, was not known heretofore.

For certain representatives of acid esters of cellulose a light sensitivity enabling the production of an image using methods of photopolymerization, photodestruction, thermoplastic recording and the like was known. Most frequently, a visible image on such materials is in the form of reliefs appearing due to differences in swelling or solubility in exposed and unexposed zones, or owing to changes in physical properties of the exposed material as a result of physical treatment of the exposed material (heating or application of an electrical charge)—bubble images, thermoplastic recording, electrophotography. To make use of the light-sensitivity in such photographic systems, it is necessary to have —C=C— bonds polarized with adjacent azides or diazo-groups (in the manner of carbonyls) responsible for light sensitivity.

The presence or absence in the composition of a polymer of —C=C— bonds, diazo-groups, pyridine residues, cross-links, thermoplastic properties and photopolymerization capacity are of no material importance for the property that we have discovered. In this case such properties do not have any predominant effect on the image formation because the formation of a latent image upon exposure of acid esters of cellulose is only determined by the presence of acid groups, and, as shown by the studies, not only of carboxyls, but also of any acid groups. The discovered property of acid esters of cellulose is inherent in these substances not only in the acid form, but also in the form of salts, such as silver, platinum, palladium, iron, bismuth and lead salts. It should be noted that the use of certain salt forms of acid esters of cellulose (palladium and silver salts) enables a photochemical treatment without the employment of a physical developer, using only reducing solutions similarly to the development of silver-halide materials. In case iron, bismuth or lead salts are used as salts of acid esters of cellulose, a copper formaldehyde developer may be used, that is the employment of precious metals is dispensed with at all stages of the photographic process, thus ensuring a low cost.

Acid ethers of cellulose which are commercially available in the form of a powder, such as carboxymethyl cellulose, sulphocellulose may also be used for the preparation of the photographic material according to the invention either by incorporating fine particles of acid ethers and esters of cellulose into the composition of gelatin films or by producing an emulsion layer of discrete particles of an acid ether or ester of cellulose distributed within the medium of polyvinyl alcohol and by applying this to a solid support (glass, wood, metal, polyethylene terephthalate films). Acid ethers and esters of cellulose in the form of powder may be applied to a support having a sticky layer.

The new photographic materials may be exposed using mercury quartz lamps of various types. The exposure time may be of the same order as that used for conventional photographic materials exposed to visible light.

Upon an exposure of the photographic materials according to the invention to ultraviolet light, a latent image is formed which is subjected to a photochemical treatment using a metal deposition to exposed areas.

The photochemical treatment of the materials on the basis of acid ethers and esters of cellulose may comprise a physical development, including an ion-exchange sorption (before or after the exposure) of metal cations capable of being reduced, with subsequent reduction to form a visible image consisting of metal particles incorporated in the material. With such photochemical treatment of the photographic material, visualization of the image does not occur directly with the use of the products of a primary photochemical process or subsequent physical or chemical treatment resulting in the production of an image consisting of the material of the polymer proper or products of a photolytic process, but rather with the use of centers of latent image functioning as catalysts in reactions causing the formation of a visible image.

Thus the image is formed by particles of either noble metals, such as silver, palladium, or such non-noble metals as copper, cobalt, nickel. It is very important that even in case precious metals are used, substantial savings thereof are ensured owing to a lower specific consumption ($10^{-5}-10^{-7}$ g/cm$^2$).

An image obtained on the new photographic materials is very stable as the substance forming the image—metal particles—is incorporated in the body of the photographic material which is both carrier and support. In conventional silverhalide and other photographic materials an image obtained in a gelatin layer is easily separable during wet treatment and under mechanical actions, and is destroyed under a moderate heating, as is the case with thermoplastic recording.

A developed image obtained on the photographic material comprising acid esters of cellulose is resistant to washing and other mechanical factors. After a developed image is produced, the photographic material is readily dyed by conventional methods, its dyeability being greater than that of an unmodified web of cellulose. Metal particles distributed within the body of each fiber ensure a reduced charging. The image stability with time depends on the stability of metal whose particles form the image. In some instances the image is very stable if formed of metal particles resistant to storage (such as silver).

It should be noted that the photographic materials according to the invention may be readily regenerated, when not developed, for re-use, which is particularly important in the applications where a continuous photorecording of a process is required with subsequent development of only a part of the exposed material which is of interest. A number of conventional materials (except for electrophotographic materials or materials for thermoplastic recording) cannot be regenerated after the exposure.

Conservation of acid groups in the composition of the photographic material after its photochemical treatment offers the possibility of re-using the material after the development.

After the removal of the visible image, an exposure and photochemical treatment of the photographic material according to the invention may be repeated. This makes it possible to obtain images by combined reproduction, to make corrections, and print-in a new image in unexposed or slightly exposed zones. At the same time, the majority of conventional photographic materials lose their light sensitivity after the development.

EXAMPLE 1

Carboxymethyl cellulose was prepared by treating cellulose with a 30% alkali solution for swelling during 30 minutes at 2°-3° C., with subsequent feeding to a reactor charged with a solution of 21% monochloroacetic acid. The reaction mass was then stirred for 18 minutes in the cold, and then heated to 70° C. and allowed to stay at this temperature for 30 minutes. The product was then washed and spread over a paper sheet. To prepare the composition in the N-form, the paper was treated with 0.1N solution of formic acid during one hour. The resultant carboxymethyl cellulose was exposed to ultraviolet rays (a full spectrum of a mercury quartz lamp with a luminous flux intensity $4.3 \cdot 10^{16}$ $\nu h/cm^2s$). The material was then developed in a physical developer consisting of two solutions:

1. 0.1N $AgNo_3$
2. phenidone-hydroquinone developer.

After the development the samples were fixed in a conventional fixing bath. The developed image was of brown color, with the color intensity growing with an increase in the exposure time. Optical densities of the exposed carboxymethyl cellulose upon development in the phenidone-hydroquinone developer depending on the exposure time were the following:

| | Exposure time (min.) | | | |
|---|---|---|---|---|
| | 1 | 4 | 8 | 12 |
| Optical density | 0.20 | 0.59 | 0.64 | 0.89 |

The material had the following gradation characteristics:

Useful exposure range: 1.2
Average gradient: 0.7
Maximum optical density: 0.9
Optical fog density: 0.02–0.05.

EXAMPLE 2

Films of cellulose triacetate ($\gamma = 2.9$) were preliminarily made. For that purpose, a 1% solution of cellulose triacetate was prepared in a mixture of methylene chloride, methanol and butyl alcohol at a volumetric ratio of 9:1:0.25, respectively.

The films with a thickness of film from 20 to 35 μm were formed on a mirror surface. The film thickness could be varied.

3.5 g of the resultant films were treated for 14 minutes under heating (including 6 minutes under boiling) with a mixture of 1N alcoholic (96%) solution of caustic soda and 14 g of monochloroacetic acid in 120 ml of water.

The film was then washed with a diluted solution of hydrochloric acid and then with distilled water to obtain a negative reaction for chlorine ion. The resultant film was a cellulose ester containing, in addition to other groups characteristic of acetylcellulose, also ionogenic carboxyls.

For light sensitivity tests, the resultant film was exposed for 10 minutes to a mercury quartz lamp with an intensity of luminous flux $2.1 \times 10^{17}$ $h\nu/cm^2s$. After the exposure physical development was made consecutively in two baths:

1. $10^{-3}N$ $PdCl_2$
2. copper-formaldehyde developer containing a complexing substance (such as K-Na-tartrate).

Optical density of the developed sample was 1.0, with optical density of fog O; gamma was 2.5 as determined from the data of characteristic curve.

EXAMPLE 3

A material from acid ester of cellulose prepared and exposed as described in Example 2 was treated, for visualization of the image, with a solution $10^{-3}N$ $AgNo_3$, washed with water and treated for one minute in a 10% solution of ammonia to remove chemically unbound silver, and then again with water for five minutes, and dried. Subsequently the material was developed in a physical developer containing a silver salt. Optical density of the developed sample was 0.90, with optical fogging density 0.09.

EXAMPLE 4

3.5 g of cellophane were treated for 16 minutes (including 11 minutes under boiling) with a mixture of 600 ml of an alcoholic (96%) solution of caustic soda and 14 g of monochloroacetic acid in 120 ml of water. The film was then treated with a diluted solution of hydrochloric acid, and then with distilled water to obtain a negative reaction for chlorine ion. To test the light-sensitive layer, the film was exposed for 10 minutes to a mercury quartz lamp with an intensity of luminous flux $2.1 \cdot 10^{17}$ $h\nu/cm^2s$. After the exposure, a photochemical treatment was conducted by physical development in two baths:

1. $10^{-3}N$ $PdCl_2$
2. copper-formaldehyde developer containing a complexing substance.

Optical density of the developed sample was 0.68 with optical fogging density 0.02.

EXAMPLE 5

Paper was prepared from cellulose citrate by impregnating chromatographic cellulose paper with a 20% solution of citric acid for 20 hours, drying and subsequent heat treatment at 125° C. for 30 minutes followed by washing with water to remove an excess of reactants. The resultant citric acid ester of cellulose was exposed to a mercury quartz lamp with an intensity of luminous flux $4.3 \times 10^{16}$ $h\nu/cm^2s$, and physically developed in two baths:

1. 0.1N $AgNO_3$ with subsequent water washing to remove chemically unbound silver
2. amidol developer.

Optical densities of the developed samples depending on the exposure time were the following:

| | Exposure time (min.) | | |
|---|---|---|---|
| | 1 | 4 | 8 |
| Optical density | 0.15 | 0.36 | 0.60 |
| Optical fogging density was | 0.02. | | |

EXAMPLE 6

A light-sensitive material on the basis of cellulose phosphate was prepared in the following manner. A cotton cloth was cooked in a soap and soda solution for 40 minutes to remove dressing, and washed in distilled water. The cloth was then placed into a thermostatically controlled vessel containing an aqueous solution of ortho-phosphoric acid and urea at a ratio of urea to phosphoric acid 4:1 mole/l, and at a bath ratio 10:1. After the impregnation during 30 minutes at 75° C. the material was squeezed and dried at 40° C. The dried material was heat treated for two minutes at 170° C., washed with hot distilled water and dried. Phosphate ester groups after the synthesis were in the form of an ammonium salt. To prepare an acid form of the light-sensitive material (H-form), the cloth was treated with 0.1N formic acid for one hour and then again washed with distilled water to a neutral reaction. The light-sensitive cloth was then exposed to a mercury quartz lamp with an intensity of luminous flux $4.8\times10^{16}$ $h\nu/cm^2s$.

The exposed material was physically developed in two baths:

1. 0.1N $AgNO_3$
2. Amidol developer.

After the development, the material was fixed in a conventional fixing bath used for fixing silver-halide materials and washed to remove an excess of fixing solution. Optical densities of the developed samples of cellulose phosphate exposed during 5 and 10 minutes were 0.93 and 1.1, respectively.

In case the second bath of the physical developer was substituted with a solution of met of developer, images toned in brown could be obtained, rather than black-and-white images.

The resultant photographic material exhibited an improved fire resistance.

EXAMPLE 7

Cellulose phosphate in the form of paper was prepared in the following manner. Chromatographic paper was placed in a thermostatically controlled vessel containing a solution of ortho-phosphoric acid and urea at a ratio of urea to phosphoric acid 4:1 mole/l and at a bath ratio 10:1. The solution was preheated to 75° C., and a sample was allowed to stay at this temperature for 30 minutes, then squeezed and dried at 40° C. The dried sample was heat treated for five minutes at 140° C., then washed with hot distilled water and dried. The resultant cellulose phosphate prepared in the form of an ammonium salt was converted into an acid form by treating with 0.1N formic-acid during one hour with subsequent washing with distilled water to a neutral reaction.

The resultant light-sensitive sample was exposed to the full spectrum of a mercury quartz lamp with an intensity of luminous flux $4.3.10^{16}$ $h\nu/cm^2s$. Physical development after the exposure was conducted in two baths:

1. 0.1N $AgNO_3$
2. Amidol developer.

Optical densities of the developed samples after the exposure for 2 and 5 minutes were 1.4 and 1.9, respectively, with optical fogging density 0.3.

EXAMPLE 8

Carboxymethyl cellulose was prepared under the conditions as described in Example 1. To form a salt, 0.1N solution of $AgNo_3$ was used, with subsequent washing with distilled water to remove adsorbed silver. The resultant salts were exposed to a mercury quartz lamp with an intensity of luminous flux $4.3.10^{16}$ $h\nu cm^2s$ and developed with a phenidone-hydroquinone developer, with subsequent treatment in conventional fixing bath and washing with water to remove an excess of fixing solution.

Optical densities of the developed samples depending on the exposure time were the following:

| | Exposure time (s) | | | | | |
|---|---|---|---|---|---|---|
| | 1 | 3 | 6 | 12 | 24 | 60 |
| Optical density | 0.30 | 0.40 | 0.65 | 0.90 | 1.04 | 0.98 |

As follows from these data, the light sensitivity of the material in the form of a salt was higher than that of the acid form.

The material had the following gradation performance:

Useful exposure time range: 0.9
Average gradient: 1.0
Maximum optical density: 1.04
Optical fogging density: 0.04.

EXAMPLE 9

Cellulose citrate was prepared as described in Example 5. For a salt formation, cellulose citrate was treated with 0.1N solution of $AgNO_3$ for 15 minutes, washed with distilled water and dried. To study the light sensitivity, a paper made of the silver salt of caboxymethyl cellulose was exposed to a mercury quartz lamp with an intensity of luminous flux $1.6\cdot10^{16}$ $h\nu/cm^2s$, with subsequent development in amidol developer. Optical fogging density was 0.02. Optical densities of the developed samples depending on the exposure time were as given below:

| | Exposure time (s) | | | | | |
|---|---|---|---|---|---|---|
| | 1 | 3 | 6 | 12 | 24 | 36 |
| Optical density | 0.26 | 0.59 | 0.94 | 1.22 | 1.37 | 1.39 |

Gradation performance of the material:
Useful exposure time range: 1.14
Average gradient: 1.1
Maximum optical density: 1.40.

EXAMPLE 10

Cellulose citrate was prepared as described in Example 5, but on the basis of the cellophane form of cellulose, rather than paper form. A silver salt of cellulose citrate was prepared as described in Example 7. The silver salt of cellulose citrate was exposed to a mercury quartz lamp with an intensity of luminous flux $1.6\cdot10^{16}$ $h\nu/cm^2s$, and then developed with a metol-hydroquinone developer. Optical density of the developed sample exposed for 15 and 30 s was 0.42 and 0.70, respectively.

EXAMPLE 11

A film material prepared as described in Example 2 was treated for a salt formation during two hours with 0.01M solution of uranyl sulphate. The film was then washed with water and dried. To test light sensitivity, uranyl salt of an acid ester of cellulose containing, in addition to carboxyls, also scetyls was exposed to UV radiation for one minute and then developer similar to that described in Example 2. Optical density of the developed sample was 0.51, optical fogging density was 0.04. Meanwhile the optical density of cellulose ester in the H-form exposed and developed under similar conditions was 0.17.

Therefore, incorporating uranyl ions in an acid ester of cellulose by way of ion-exchange sorption improved the light sensitivity of the material by three times. It should be noted that upon an exposure of uranyl salt of an acid ester of cellulose to a radiation of a mercury quartz lamp passing through a light filter having a passband above 350 nm, and subsequent development under conditions similar to those described in Example 2, a visible image was formed with an optical density of 0.35 after a 15 minute exposure and with an optical fogging density 0.04, which attests to the possibility of sensitization of the material in respect of the near ultraviolet radiation by incorporating metal ions in the material.

EXAMPLE 12

Cellulose phosphate in the form of a paper, prepared as described in Example 6, was treated for one hour with 0.1N solution of copper acetate to prepare a copper salt of acid ester of cellulose. The copper salt of cellulose phosphate was then exposed to a mercury quartz lamp with an intensity of luminous flux $4.3\times10^{16}$ $h\nu/cm^2s$ during five minutes. A sample was physically developed in 0.1N solution of $AgNO_3$ with subsequent fixing in a conventional fixing bath and washed with water to remove an excess of fixing solution.

Optical density of the developed sample was 0.48 with optical fogging density 0.05.

Therefore, in case the photographic material comprises copper salt of cellulose phosphate, the development may be conducted in a single bath.

EXAMPLE 13

To dispense with the use of precious metal compounds at all stages of the photographic process and thereby to lower the cost of photographic materials, salts of acid esters of cellulose were used in which a cation was ferric ion, and an anion was an acid group of a respective ester.

Cellulose citrate prepared in the form of paper under conditions similar to those described in Example 5 was treated with a $10^{-2}$M solution of ferric chloride during five minutes. The samples were then washed with distilled water to remove adsorbed ferric ions and dried. The resultant material was exposed to a mercury quartz lamp with an intensity of luminous flux $6.8\cdot10^{15}$ $h\nu/cm^2s$. The exposure time was 90 s.

The developments was conducted by the method of a photochemical treatment, including two baths:

1. an alkaly solution of formaldehyde,
2. copper-formaldehyde developer containing glycerin.

The resultant photographic image was characterized by a sufficient density (up to 1) and high gamma.

EXAMPLE 14

Samples of caboxymethyl cellulose prepared as described in Example 1 were treated during five hours with a solution of ferric chloride of a concentration of $10^{-2}$M, washed, dried and exposed for three minutes to a mercury quartz lamp with an intensity of luminous flux $6.8\cdot10^{15}$ $h\nu/cm^2s$. The development was conducted as described in Example 1.

The resultant image was characterized by high density and absolute absence of fog.

EXAMPLE 15

To prepare a light-sensitive material exhibiting an improved resistance to an alkali medium and thermal stability, a copolymer of cellulose phosphate and polyacrylonitrile was prepared.

Synthesis of grafted copolymer was conducted in a redox system of cellulose phosphate and $Fe^{2+}$—$H_2O_2$. Copolymerization was conducted in the following manner: 0.5 g of cellulose phosphate prepared as described in Example 9 were placed in a flask containing 100–150 ml of a 1% solution of $FeSO_4.7H_2O$ at pH 4.3 to 4.8, at room temperature for 5 to 10 minutes. The excess of $Fe^{2+}$ was washed off with distilled water at pH=5. The sample was then placed in a solution of acrylonitrile of a concentration of 1.1 mole/l. Polymerization was conducted for two hours at 60° C. Polymerization was initiated with hydrogen peroxide used in a concentration 0.002 mole/l. After the polymerization was over, the copolymer was thoroughly washed with water to a constant weight. To remove $Fe^{2+}$ remaining in the grafted cellulose, 0.5M solution of oxalic acid was used.

The resultant copolymer of cellulose phosphate and polyacrylonitrile was exposed to a mercury quartz lamp with an intensity of luminous flux $4.3\cdot10^{16}$ $h\nu/cm^2s$.

The sample was developed as described in Example 9. Optical density of the developed sample exposed for five minutes was 0.86.

The study on resistance to alkali of the light-sensitive material prepared from copolymer of cellulose phosphate and polyacrylonitrile showed that under the action of a 10% alkali during 24 hours, no defibrilation of the product occurred, whereas unmodified cellulose lost its fibrous structure under such conditions.

Therefore, copolymerizing light-sensitive acid cellulose ethers and esters with comonomers differing in chemical structure and properties enabled a modification of the complex of physical and chemical properties of the photographic material.

EXAMPLE 16

5 ml of a 5% aqueous solution of polyvinyl alcohol were mixed together with 0.4 g of carboxymethyl cellulose powder. The suspension was applied to a cleaned glass (1 ml per 8 $cm^2$). Then the glass with the applied suspension of carboxymethyl cellulose in polyvinyl alcohol was heated at 80° C. for two hours. The applied layer was resistant to water and solutions used for photochemical treatment.

The resultant emulsion layer was tested as to light sensitivity by exposing it to a mercury quartz lamp for one minute.

After the exposure, the material was developed by the method of physical development in two baths:

1. $PdCl_2$ of $10^{-3}M$ concentration.
2. copper-formaldehyde developer.

Optical density of the developed sample measured with reference to a standard sample (barite plate) was 0.98.

EXAMPLE 17

A light-sensitive film of sulfoethyl cellulose was prepared in the following manner: 0.5 g of commercial sulfoethyl cellulose (in the form of powder) containing ionogenic sulphate groups (in the composition of ester group $C_2H_4SO_3H$) prepared under commercial conditions by treating cellulose with sodium bromoethyl-sulfonate or sodium chloroethylsulfonate in an alkali medium were mixed with 10 ml of a 5% solution of gelatin, and the mixture was applied to a glass at a rate of 1 ml per 8 $cm^2$, whereafter the sample was dried in the air. The resultant lightsensitive film was exposed to a mercury quartz lamp and physically developed in two baths:

1. 0.1N $AgNO_3$
2. metol-hydroquinone developer.

After the development, the sample was fixed in a conventional fixing bath. Optical density of the developed sample exposed for five minutes was 0.30.

EXAMPLE 18

Paper of cellulose citrate (prepared as described in Example 5) was treated for a salt formation with 0.1M solution of bismuth tartrate, washed with water to remove adsorbed $Bi^{3+}$, and dried. The resultant sample was exposed to a mercury, quartz lamp with an intensity of luminous flux $0.75 \cdot 10^{16} h\nu/cm^2s$ for two minutes, physically developed in a copper-formaldehyde developer, and washed with water.

Optical density of the developed sample was 0.65, with optical fogging density 0.02.

The material exhibited a good stability of the developed image with time, the image was developed in a single bath thus facilitating the production of images.

EXAMPLE 19

Carboxymethyl cellulose prepared as described in Example 1 was treated for a salt formation with 0.1M solution of bismuth acetate, washed with water to remove mechanically sorbed ions $Bi^{3+}$, dried and exposed to a mercury quartz lamp with an intensity of luminous flux $0.75 \cdot 10^{16} h\nu/cm^2s$.

After the exposure the samples were developed in a physical copper-formaldehyde developer and washed with water. Optical densities of the developed samples exposed for 0.5; 1 and 2 minutes were 0.23; 0.53; 0.77, respectively, with practically complete absence of fogging.

EXAMPLE 20

Lead salts of acid esters of cellulose were prepared by treating cellulose citrate with 0.1M solution of lead acetate, with subsequent drying. To produce an image, a salt was exposed to a mercury quartz lamp and developed in a copper formaldehyde developer. The resultant photographic images were characterized by a susficiently high optical density (1.3–1.4) for paper, and gamma. Optical density of fogging was practically zero.

EXAMPLE 21

As light-sensitive materials, the use may also be made of copolymers of cellulose and synthetic comonomers containing acid groups, such as a copolymer of cellulose and acrylic acid. When exposed to a mercury quartz lamp, during four minutes, with subsequent development in a physical developer including two baths:

1. $PdCl_2$ $10^{-3}M$
2. copper-formaldehyde developer, an image exhibiting a sufficient optical density as high as 0,9, and high gamma was obtained.

What is claimed is:

1. A method for producing an image on a photographic material wherein said image is exposed to ultraviolet radiation which comprises the steps of:

(a) exposing said image on a photographic material consisting essentially of at least one member selected from the group consisting of acid ethers of cellulose, acid esters of cellulose, salts of acid ethers of cellulose, salts of acid esters of cellulose, polymers of acid ethers of cellulose with acrylic monomers, polymers of acid esters of cellulose with acrylic monomers, salts of polymers of acid ethers of cellulose with acrylic monomers and salts of polymers of acid esters of cellulose with acrylic monomers, said members being substantially water-insoluble and having the ability of forming metastable electron-excess centers of latent image under the action of ultraviolet radiation, (b) treating said exposed photographic material with an aqueous solution containing reducible metal ions, and (c) treating said exposed photographic material with a solvent for selectively reducing said metal ions at exposed portions of said photographic material to develop said image.

2. A method for producing an image on a photographic material wherein said image is exposed to ultraviolet radiation which comprises the steps of:

(a) exposing said image on a photographic material consisting essentially of at least one member selected from the group consisting of salts of noble metals of acid esters of cellulose and salts of noble metals of acid ethers of cellulose, said member being substantially water-insoluble and having the ability of forming metastable electron-excess centers of latent image under the action of ultraviolet radiation, (b) treating said exposed photographic material with an aqueous solution containing a reducing agent for the selective reduction of ions of said metals at exposed portions of said photographic materials to develop said image.

3. A process as claimed in claim 1, wherein said photographic mateial consists essentially of carboxymethylcellulose.

4. A process as claimed in claim 3, wherein said carboxymethyl cellulose contains acetyl groups.

5. A process as claimed in claim 1, wherein said photographic material incorporates cellulose phosphate.

6. A process as claimed in claim 1, wherein said photographic material contains salts of acid esters of cellulose.

7. A process as claimed in claim 6, wherein said salt of said acid ester of cellulose is a salt selected from a group consisting of iron salt, bismuth salt and uranium salt.

8. A process as claimed in claim 1, wherein said photographic material incorporates salts of acid ethers of cellulose.

9. A process as claimed in claim 8, wherein said salt of acid ether of cellulose is a salt selected from a group consisting of lead salt, bismuth salt, and iron salt.

10. A process as claimed in claim 1, wherein said aqueous solution contains ions of copper, nickel, cobalt, silver, palladium and platinum.

11. A process as claimed in claim 1, wherein the exposed photographic material containing the latent image is treated with an aqueous solution comprising reducible metal ions and a reducing agent.

12. A photographic article suitable for use in recording latent images, comprised of, in combination, a support, a light sensitive composition contained on said support in a manner suitable for recording images and means for shielding said composition from light until used; said composition being sensitive exclusively to ultraviolet light and consisting essentially of at least one member selected from the group consisting of acid ethers of cellulose, acid esters of cellulose, salts of acid ethers of cellulose, salts of acid esters of cellulose, polymers of acid ethers of cellulose with acrylic monomers, polymers of acid esters of cellulose with acrylic monomers, salts of polymers of acid ethers of cellulose with acrylic monomers and salts of polymers of acid esters of cellulose with acrylic monomers, said member being substantially water-insoluble and having acid groups capable of dissociation and ion exchange, said acid groups being present in an amount of from 0.3 to 17 percent by weight of said member.

* * * * *